US005430898A

United States Patent [19]

Wang

[11] Patent Number: 5,430,898

[45] Date of Patent: Jul. 11, 1995

[54] BATH TUB SUPPORTING MECHANISM

[76] Inventor: Sung-Shun Wang, 58, Ma Yuan West St., Taichung, Taiwan

[21] Appl. No.: 246,684

[22] Filed: May 23, 1994

[51] Int. Cl.[6] ..... A47K 3/16

[52] U.S. Cl. ..... 4/592

[58] Field of Search ..... 4/592, 593, 594, 613

[56] References Cited

U.S. PATENT DOCUMENTS 1,116,015 11/1914 Clifford ..... 4/594
5,241,713 9/1993 Wang ..... 4/593

FOREIGN PATENT DOCUMENTS 1932439 1/1970 Germany ..... 4/593
1080712 8/1967 United Kingdom ..... 4/592

*Primary Examiner*—Charles E. Phillips

[57] ABSTRACT

A bath tub includes a board and a base disposed in the bottom portion for supporting the bath tub. The base includes a recess formed in the middle portion for receiving the board and a number of lugs extended inward of the recess for engaging with the board so as to retain the board in the base. The base includes a groove formed in the peripheral portion, the bath tub includes a flange extended from the upper peripheral portion, and one or more plates include a number of hooks for engaging with the groove and the flange such that the plates may form the wall member of the bath tub.

1 Claim, 5 Drawing Sheets

BATH TUB SUPPORTING MECHANISM

BACKGROUND OF THE INVENTION

1. Field of the Invention

The present invention relates to a bath tub, and more particularly to a bath tub assembly having a mechanism for supporting the bath tub body.

2. Description of the Prior Art

A typical bath tub is shown in FIGS. 1 to 3 and comprises a cement frame A having a hollow interior for receiving the bath tub body 1. An outlet D is formed in the bottom of the cement frame A. The bath tub body 1 includes a number of pads 11 provided on the bottom portion thereof for engaging with the bottom surface of the cement frame A. An aperture 12 is formed in the bottom portion and an orifice 14 is formed in the side portion of the bath tub body 1, the aperture 12 and the orifice 14 are connected to the outlet D by a tube 13. However, the pads 11 may not stably support the bottom portion of the bath tub body 1 and the bath tub body 1 is usually broken beginning from the bottom portion. In addition, the bath tub body 1 is solidly secured to the cement frame A and can not be easily disengaged from the cement frame A; i.e., the bath tub body may not be disengaged and reassembled in other place.

The present invention has arisen to mitigate and/or obviate the afore-described disadvantages of the conventional bath tub assemblies.

SUMMARY OF THE INVENTION

The primary objective of the present invention is to provide a bath tub assembly having a supporting mechanism for stably supporting the bath tub body.

In accordance with one aspect of the invention, there is provided a bath tub assembly comprising a base including a recess formed therein and having an upper portion, a plurality of lugs extended inward of the recess from the upper portion of the recess, the base including an upper surface having a peripheral portion, a groove formed in the peripheral portion of the base; a board engaged in the recess of the base and including an outer peripheral portion having a slot formed therein for engaging with the lugs so as to stably retain the board in the recess, the board including a bottom portion having a plurality of cavities formed therein, a plurality of blocks engaged in the cavities of the board for engaging with the base; a bath tub body secured on top of the board and including an upper peripheral portion having a flange extended outward therefrom; and at least one plate including a plurality of hooks provided thereon for engaging with the flange of the bath tub body and for engaging with the groove of the base so as to secure the plate to the base and the bath tub body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
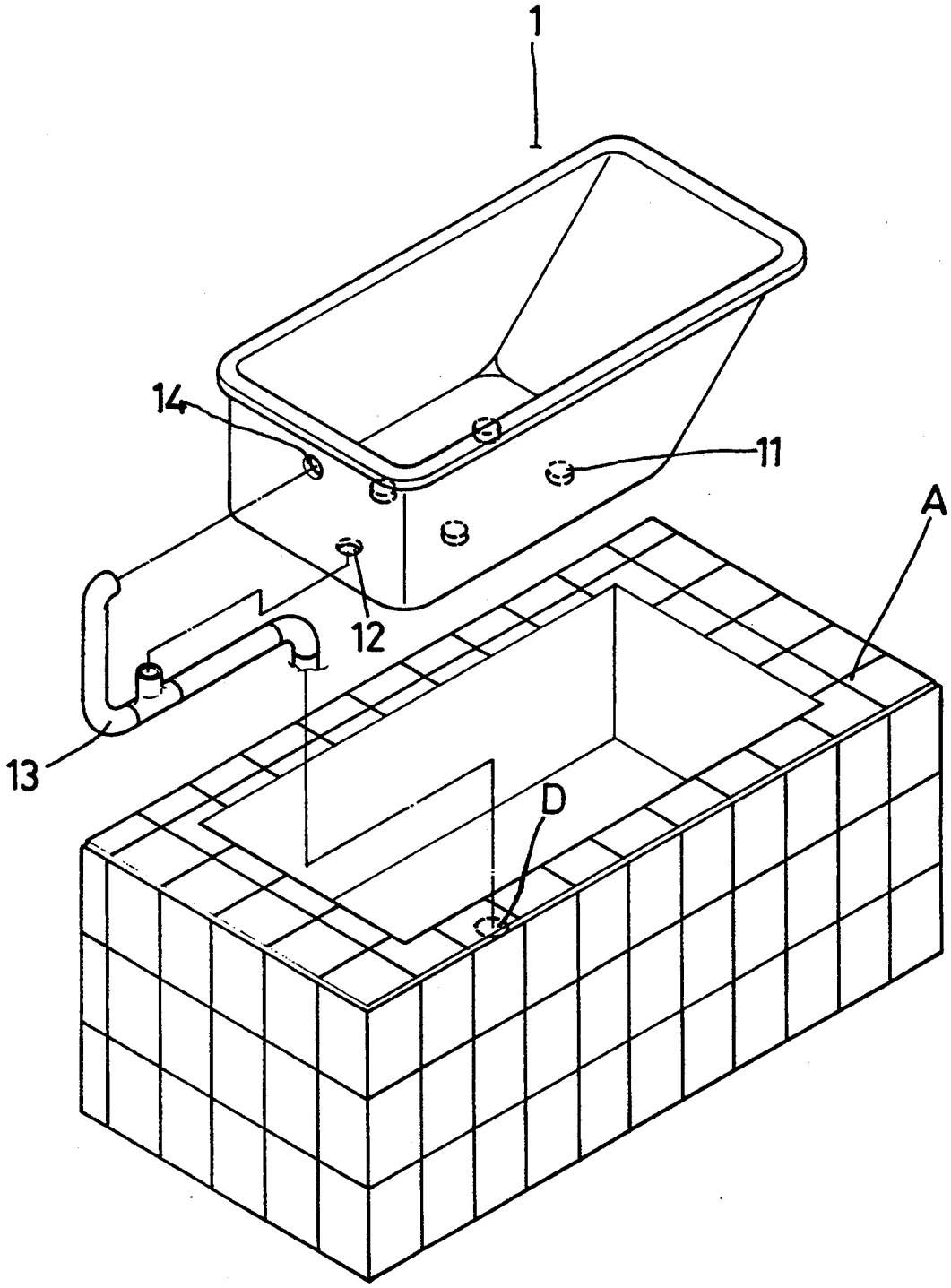
FIG.1 PRIOR ART
FIG. 1 is an exploded view of a typical bath tub assembly.
Figure 2:
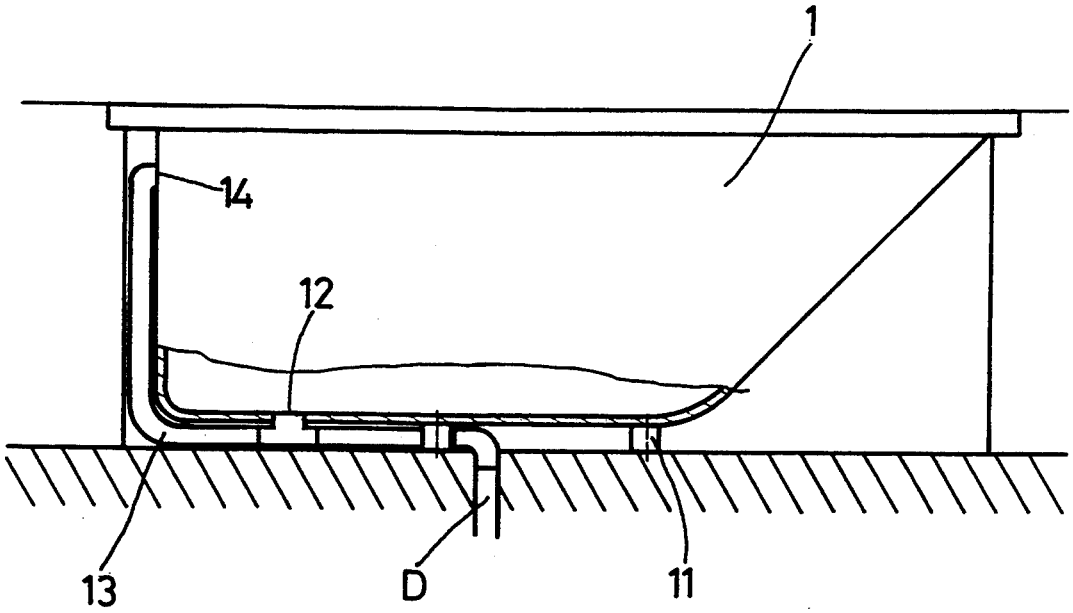
FIG. 2 PRIOR ART
FIG. 2 is a cross sectional view of the typical bath tub assembly.
Figure 3:
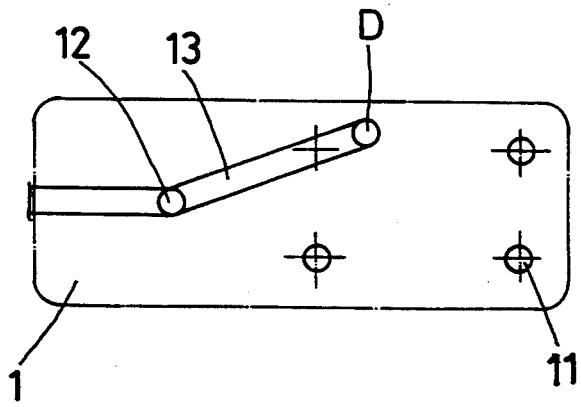
FIG. 3 PRIOR ART
FIG. 3 is a bottom schematic view of the typical bath tub assembly.
Figure 4:
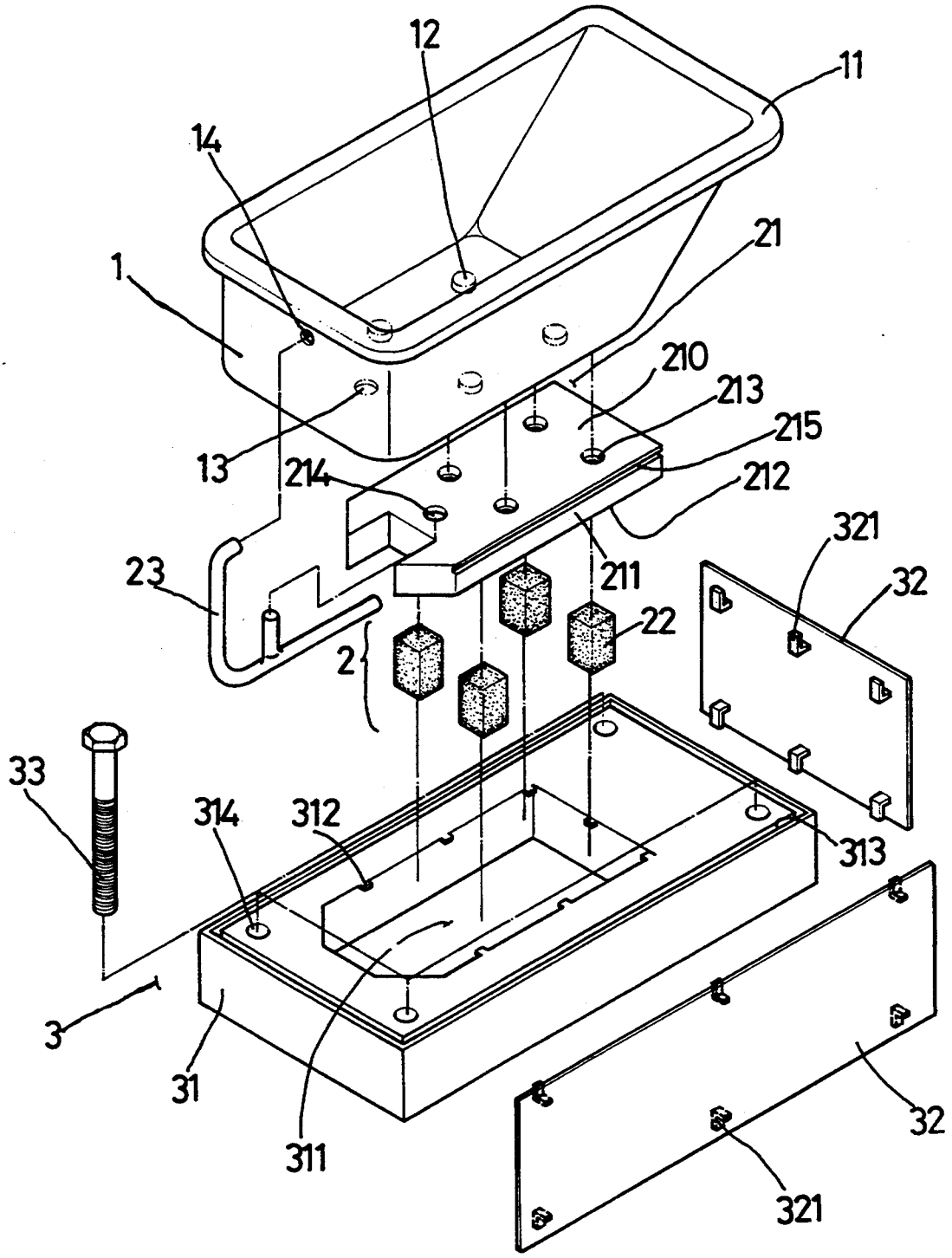
FIG. 4 is an exploded view of a bath tub assembly in accordance with the present invention.
Figure 5:
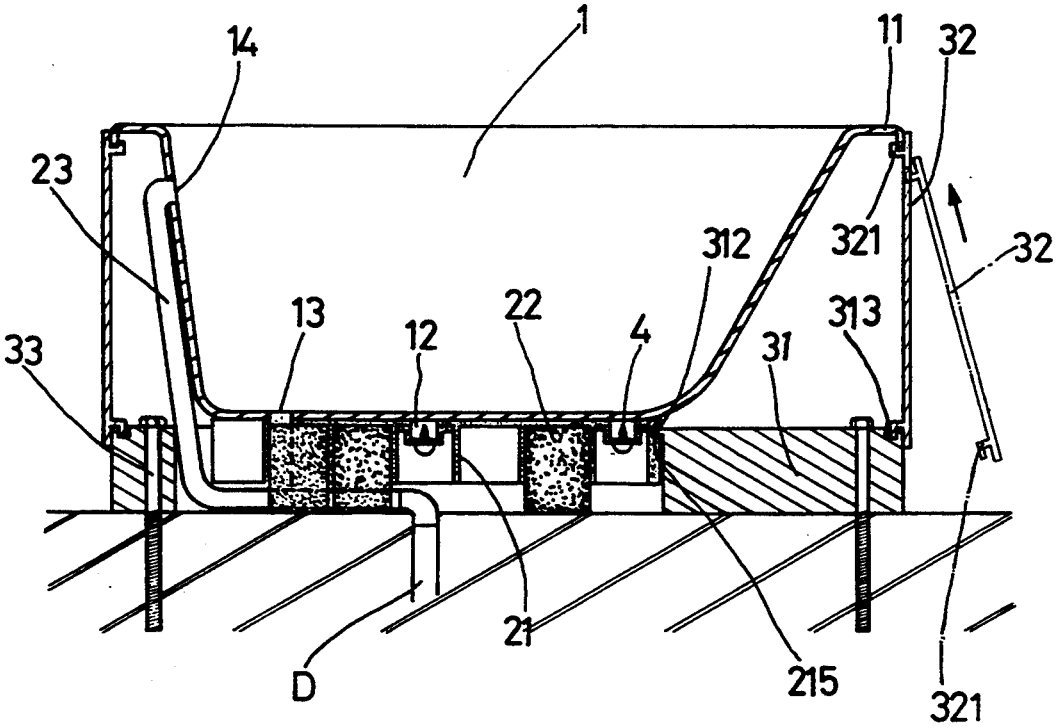
FIG. 5 is a cross sectional view of the bath tub assembly of the invention.
Figure 6:
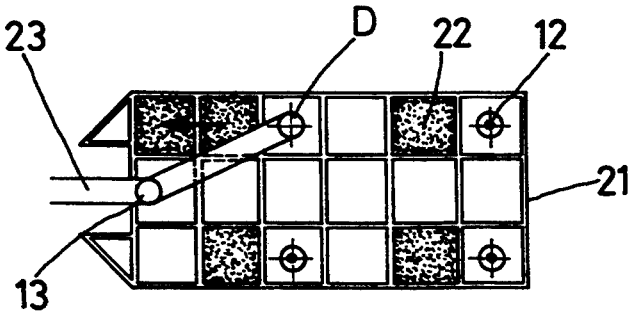
FIG. 6 is a bottom schematic view of the bath tub assembly of the invention.

Referring to the drawings, and initially to FIGS. 4 to 6, a bath tub assembly in accordance with the present invention comprises a bath tub body 1 disposed on a supporting device 2 and a base 3. The bath tub body 1 includes a flange 11 extended outward from the upper peripheral portion thereof, four pads 12 provided on the bottom portion, an aperture 13 formed in the bottom and an orifice 14 formed in the side portion. A tube 23 connects the aperture 13 and the orifice 14 to a typical outlet D.

The supporting device 2 includes a board 21, the board 21 includes an upper surface 210 for engaging with the bottom surface of the bath tub body 1, two side surfaces 211 each having a slot 215 formed therein, and a bottom portion 212 having a number of cavities (FIGS. 5 and 6) provided therein for receiving a number of blocks 22. Four cavities 213 are formed in the upper surface 210 of the board 21 for receiving the pads 12, screws 4 (FIG. 5) fix the board 21 to the body 1. A hole 214 is formed in the board 21 and aligned with the aperture 13 for engaging with manifold of the tube 23.

Figure 7:
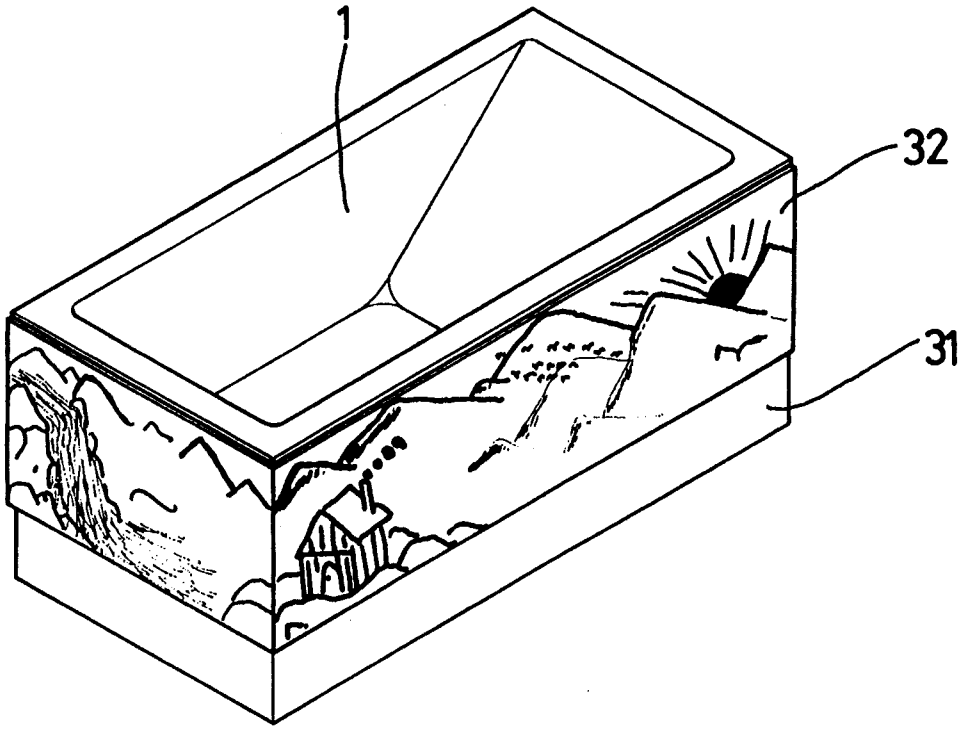
FIG. 7 is a perspective view of the bath tub assembly of the invention.

The base 3 includes a body 31 having a recess 311 formed therein for receiving the supporting device 2, a number of lugs 312 extended inward from the upper portion of the recess 311 for engaging with the slots 215 of the board 21 so as to retain the supporting device 2 in the recess 311. The lugs 312 of the base 3 may be engaged with the slots 215 of the board 21 by forcing the board 21 into the recess 311. Four holes 314 are formed in the four corner areas of the body 31 for engaging with bolts 33 so as to fix the body 31 to the floor. The peripheral portion of the upper surface of the body 31 includes a groove 313 formed therein. Two plates 32 each having a number of hooks 321 provided thereon for engaging with the flange 11 of the bath tub body 1 and for engaging with the groove 313 of the base body 31. As best shown in FIG. 7, the plates 32 may be provided with beautiful patterns thereon for decoration purposes.

It is to be noted that the bath tub body 1, the supporting device 2 and the base 3 can be easily assembled and fixed in the location according to user's desire. The bath tub assembly can also be easily disassembled and reassembled in other place, the bath tub assembly is excellent for Do-It-Yourself (DIY).

Accordingly, the bath tub assembly in accordance with the present invention includes a configuration that can be easily assembled and disassembled, and includes a supporting mechanism for stably supporting the bath tub body, Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bath tub assembly comprising:

a base including a recess formed therein and having an upper portion, a plurality of lugs extended inward of said recess from said upper portion of said recess, said base including an upper surface having a peripheral portion, a groove formed in said peripheral portion of said base;

a board engaged in said recess of said base and including an outer peripheral portion having a slot formed therein for engaging with said lugs so as to stably retain said board in said recess, said board including a bottom portion having a plurality of cavities formed therein, a plurality of blocks engaged in said cavities of said board for engaging with said base;

a bath tub body secured on top of said board and including an upper peripheral portion having a flange extended outward therefrom; and at least one plate including a plurality of hooks provided thereon for engaging with said flange of said bath tub body and for engaging with said groove of said base so as to secure said plate to said base and said bath tub body.

* * * * *